US005138385A

United States Patent [19]

Toyoshi et al.

[11] Patent Number: 5,138,385

[45] Date of Patent: Aug. 11, 1992

[54] DEVELOPING DEVICE WITH ELECTRICALLY FLOATING DEVELOPING ROLLER

[75] Inventors: Naoki Toyoshi; Tateki Oka, both of Toyohashi, Japan

[73] Assignee: Minolta Camera Kabushiki Kaisha, Osaka, Japan

[21] Appl. No.: 721,390

[22] Filed: Jun. 26, 1991

[30] Foreign Application Priority Data

Jun. 27, 1990 [JP] Japan ..... 1-169605

[51] Int. Cl.[5] ..... G03G 21/00

[52] U.S. Cl. ..... 355/246; 118/651; 118/656; 355/259

[58] Field of Search ..... 355/251, 253, 259, 268, 355/245, 246; 118/656, 657, 658, 651

[56] References Cited

U.S. PATENT DOCUMENTS 3,599,605 8/1971 Ralston et al. ..... 118/637
4,286,866 9/1981 Stelber et al. ..... 355/270
4,466,732 8/1984 Folkins ..... 118/657 X
4,791,882 12/1988 Enoguchi et al. ..... 118/653
4,833,500 5/1989 Mochizuki et al. ..... 355/256
5,001,517 3/1991 Hosaka et al. ..... 355/268

*Primary Examiner*—A. T. Grimley
*Assistant Examiner*—Christopher Horgan
*Attorney, Agent, or Firm*—Burns, Doane, Swecker & Mathis

[57] ABSTRACT

A developing device for supplying toner particles to an electrostatic latent image support member having an electrostatic latent image formed thereon to develop the electrostatic latent image comprises a toner conveying member for conveying and supplying the toner particles to the electrostatic latent image support member having the electrostatic latent image formed thereon, a power supply for applying a predetermined developing bias voltage to said toner conveying member, and charge movement preventing means connected between the toner conveying member and the power supply for preventing charges induced in the toner conveying member as the electrostatic latent image is developed from flowing toward the power supply.

12 Claims, 5 Drawing Sheets

DEVELOPING DEVICE WITH ELECTRICALLY FLOATING DEVELOPING ROLLER

BACKGROUND OF THE INVENTION

1. Field of the Invention

The present invention relates generally to a developing device for developing an electrostatic latent image formed on an electrostatic latent image support member using toner particles in an image forming apparatus such as a printer, and more particularly, to a developing device using a monocomponent developer (referred to as monocomponent developing device hereinafter) so adapted that a toner conveying member for conveying toner particles to an electrostatic latent image support member is brought into contact with the surface of the electrostatic latent image support member and a developing bias voltage is applied to the toner conveying member from a power supply to supply toner particles charged to the same polarity as that of an electrostatic latent image formed on the electrostatic latent image support means to the electrostatic latent image support member from the toner conveying member to develop the electrostatic latent image by reversal development.

2. Description of the Prior Art

As a developing device used in an image forming apparatus such as a printer, a monocomponent developing device using only toner particles as a developer has been conventionally known in addition to a developing device using a two-components developer, that is, using toner particles and a carrier as a developer (referred to as two-components developing device hereinafter).

In recent year, the above described monocomponent developing device has received attention because its structure is generally simpler so that it can be made smaller in size and lower in cost, as compared with the two-components developing device.

Examples of such a monocomponent developing device generally include one so adapted that toner particles are supplied to the surface of a toner conveying member, a blade is brought into contact with the surface of the toner conveying member thus supplied with the toner particles by applying pressure to charge the toner particles supplied to the surface of the toner conveying member by triboelectric charging as well as to control the amounts of the toner particles supplied to the surface of the toner conveying member and then, the toner particles thus charged by triboelectric charging are conveyed to an electrostatic latent image support member by the toner conveying member, and the toner conveying member is brought into contact with the surface of the electrostatic latent image support member to supply the toner particles to the electrostatic latent image support member from the toner conveying member.

In the monocomponent developing device, however, when the toner conveying member is brought into contact with the electrostatic latent image support member, such a phenomenon occurs that the toner particles are supplied to the electrostatic latent image support member from the toner conveying member even when the potential difference between the toner conveying member and the electrostatic latent image support member is zero volt, unlike the two-components developing device using toner particles and a carrier as a developer.

The foregoing will be described in more detail. In the two-components developing device using toner particles and a carrier as a developer, when toner particles 1 are negatively charged, a carrier 101 is positively charged, as shown in FIG. 1. That is, the toner particles 1 and the carrier 101 are respectively charged to opposite polarities so that the entire developer has no charges.

In the above described two-components developing device, therefore, when both the surface potential of an electrostatic latent image support member 2 and the potential of a toner conveying member 15 are zero volt, the potential of the developer between the electrostatic latent image support member 2 and the toner conveying member 15 becomes a straight line connecting the surface potential of the electrostatic latent image support member 2 and the potential of the toner conveying member 15, that is, has no gradient, as shown in FIG. 1. Consequently, the toner particles 1 are not moved to the electrostatic latent image support member 2 from the toner conveying member 15.

On the other hand, in the above described monocomponent developing device, the developer is constituted by only toner particles 1 charged either negatively or positively, as shown in FIG. 2. Accordingly, even when both the surface potential of an electrostatic latent image support member 2 and the potential of a toner conveying member 15 are zero volt, the potential of the developer between the electrostatic latent image support member 2 and the toner conveying member 15 is expanded in the direction of polarity to which the toner particles 1 are charged between the electrostatic latent image support member 2 and the toner conveying member 15, as shown in FIG. 2. Consequently, part of the toner particles 1 are supplied to the electrostatic latent image support member 2.

When the monocomponent developing device is driven from a state where it is stopped with the toner conveying member 15 holding the toner particles 1 being in contact with the surface of the electrostatic latent image support member 2, as shown in FIG. 3, the toner conveying member 15 and the electrostatic latent image support member 2 are rotated and a charger 3 is turned on, to charge the electrostatic latent image support member 2 by the charger 3.

When the developing device is thus driven, a portion of the above electrostatic latent image support member 2 on the downstream side of the position opposed to the above charger 3 in the direction of rotation of the above electrostatic latent image support member 2 is not charged by the charger 3, so that the surface potential of the portion is zero volt. Further, in a state where a power supply 18 connected to the toner conveying member 15 is turned off, the potential of the toner conveying member 15 is also zero volt.

Therefore, when a portion $\theta$ of the above described electrostatic latent image support member 2 on the downstream side of the position opposed to the charger 3 in the direction of rotation of the electrostatic latent image support member 2 to a point in contact with the toner conveying member 15 is brought into contact with the toner conveying member 15 holding the toner particles 1 by the rotation of the electrostatic latent image support member 2 and the toner conveying member 15, the toner particles 1 are supplied to the electrostatic latent image support member 2 from the toner conveying member 15 in the above described portion $\theta$ of the electrostatic latent image support member 2, as described with reference to FIG. 2, because both the surface potential of the electrostatic latent image support member 2 and the potential of the toner conveying member 15 are zero volt.

In the above described monocomponent developing device, consider a case where the above toner particles 1 are charged to opposite polarity to that of an electrostatic latent image formed on the electrostatic latent image support member 2 to develop the electrostatic latent image by normal development. In this case, if the above power supply 18 is turned on to apply to the toner conveying member 15 a developing bias voltage having opposite polarity to that of the toner particles 1 simultaneously with the driving of the developing device, the toner particles 1 can be prevented from being supplied to the electrostatic latent image support member 2.

On the other hand, in the above described monocomponent developing device, consider a case where the toner particles 1 are charged to the same polarity as that of the electrostatic latent image formed on the electrostatic latent image support member 2 to develop the electrostatic latent image by reversal development. In this case, if the power supply 18 is turned on in the same manner as the case of the above described normal development, a developing bias voltage having the same polarity as that of the toner particles 1 is applied to the toner conveying member 15, so that the toner particles 1 are further supplied to the electrostatic latent image support member 2.

In the case of the above described reversal development, therefore, the power supply 18 must not be turned on, because as a result of this, the toner particles 1 are supplied to the portion $\theta$ whose surface potential is zero volt of the electrostatic latent image support member 2 as described above to be consumed wastefully.

In order to solve the above described problem, inventors of the present application came up with the idea of using as the power supply 18 one capable of selecting two types of voltages in the developing device shown in FIG. 3 to apply a voltage having opposite polarity to that in the case of reversal development to the toner conveying member 15 from the above power supply 18 until the portion $\theta$, which is not charged by the charger 3, of the electrostatic latent image support member 2 passes through the point in contact with the toner conveying member 15 when the developing device is driven.

However, the above described power supply 18 capable of selecting two types of voltages is high in cost, and an operation for switching voltages in the above power supply 18 becomes complicated.

Then, the inventors of the present application came up with the idea of providing a switching device 4 between the toner conveying member 15 and the power supply 18 to turn the switching device 4 off using control means such as a relay so that the toner conveying member 15 is placed in an electrically floating state until the portion $\theta$, which is not charged by the charger 3, of the electrostatic latent image support member 2 passes through the point in contact with the toner conveying member 15 as described above at the time of starting the developing device.

In a case where the switching device 4 is thus turned off so that the toner conveying member 15 is placed in an electrically floating state until the portion $\theta$, which is not charged by the charger 3, of the electrostatic latent image support member 2 passes through the point in contact with the toner conveying member 15, when the toner particles 1 negatively charged are supplied to the electrostatic latent image support member 2 from the toner conveying member 15, positive charges having opposite polarity to that of the toner particles 1 are produced on the surface of the toner conveying member 15, as shown in FIG. 5. The positive charges are maintained in the toner conveying member 15 without flowing toward the power supply 18 from the toner conveying member 15.

Consequently, the potential of the toner conveying member 15 is instantaneously raised to a voltage $V_1$ corresponding to the positive charges thus maintained in the toner conveying member 15 from zero volt, as shown in FIG. 6, due to the positive charges. Accordingly, the toner particles 1 are attracted to the toner conveying member 15, not to be supplied to the electrostatic latent image support member 2.

When the switching device 4 is turned on or off by the control means such as a relay as described above, however, the control becomes complicated and the stable control is difficult so that the control lacks reliability.

The inventors of the present application further study the above described monocomponent developing device for developing the electrostatic latent image by reversal development so as to prevent the toner particles from being supplied to the electrostatic latent image support member from the toner conveying member to be wastefully consumed at the beginning of driving the developing device, leading to the completion of the present invention.

SUMMARY OF THE INVENTION

An object of the present invention is to prevent, in a developing device so adapted that toner particles are conveyed by a toner conveying member, the toner conveying member is brought into contact with the surface of an electrostatic latent image support member and a developing bias voltage is applied to the toner conveying member from a power supply to supply the toner particles to the electrostatic latent image support member from the toner conveying member to develop an electrostatic latent image formed on the electrostatic latent image support member, the toner particles from being supplied to the electrostatic latent image support member from the toner conveying member to be wastefully consumed at the beginning of driving the developing device.

Particularly in the present invention, when toner particles charged to the same polarity as that of the electrostatic latent image formed on the electrostatic latent image support member are supplied to the electrostatic latent image support member from the toner conveying member to develop the electrostatic latent image by reversal development, the toner particles are simply prevented from being supplied to the electrostatic latent image support member from the toner conveying member to be wastefully consumed at the beginning of driving the developing device.

Another object of the present invention is to prevent toner particles from being supplied to an electrostatic latent image support member from a toner conveying member to be wastefully consumed at the beginning of driving a developing device as well as to make it possible to stably develop an electrostatic latent image formed on the electrostatic latent image support member using the developing device.

In the present invention, a developing device for supplying toner particles to an electrostatic latent image support member having an electrostatic latent image formed thereon to develop the electrostatic latent image comprises a toner conveying member for conveying and supplying the toner particles to the electrostatic latent image support member having the electrostatic latent image formed thereon, a power supply for applying a predetermined developing bias voltage to the above toner conveying member, and charge movement preventing means connected between the above toner conveying member and the above power supply for preventing charges induced in the toner conveying member as the electrostatic latent image is developed from flowing toward the power supply.

Meanwhile, when a portion, which is not charged by a charger, of the electrostatic latent image support member is brought into contact with the toner conveying member to supply toner particles charged to the electrostatic latent image support member from the toner conveying member at the beginning of driving the above described developing device, charges having opposite polarity to that of the toner particles are produced on the surface of the toner conveying member. If the charge movement preventing means for preventing charges induced in the toner conveying member as the electrostatic latent image is developed from flowing toward the power supply is thus provided between the toner conveying member and the power supply, the charges remain in the toner conveying member without flowing toward the power supply. The toner particles are attracted to the toner conveying member due to the charges, not to be supplied to the electrostatic latent image support member, resulting in decreased wasteful consumption of the toner particles.

Furthermore, if a voltage regulator such as a Zener diode or a varistor is used as the above charge movement preventing means, the toner conveying member is placed in an electrically floating state by the voltage regulator unless a voltage corresponding to the charges produced in the toner conveying member reaches the breakdown voltage of the voltage regulator until the developing bias voltage is applied to the toner conveying member from the power supply. When the toner particles charged are supplied to the electrostatic latent image support member from the toner conveying member so that charges having opposite polarity to that of the toner particles are produced on the surface of the toner conveying member as described above, therefore, the above voltage regulator prevents the charges produced from flowing toward the power supply. Accordingly, the charges having opposite polarity to that of the toner particles remain in the toner conveying member. The toner particles are attracted to the toner conveying member due to the charges, not to be supplied to the electrostatic latent image support member, resulting in decreased wasteful consumption of the toner particles.

Additionally, in the developing device according to the present invention, means for rendering the charge movement preventing means electrically conductive when the power supply is operated is provided between the above toner conveying member and the above charge movement preventing means, to render the above charge movement preventing means conductive when the developing bias voltage is applied to the toner conveying member from the power supply.

In the above described manner, when the developing bias voltage is applied to the toner conveying member from the power supply to develop the electrostatic latent image formed on the electrostatic latent image support member, charges having opposite polarity to that of the toner particles charged which are produced on the surface of the toner conveying member when the toner particles are supplied to the electrostatic latent image support member from the toner conveying member flow from the toner conveying member through the above charge movement preventing means which is rendered conductive. Consequently, the developing bias voltage is not changed depending on the charges produced as described above but is kept constant, to make it possible to achieve stable development.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
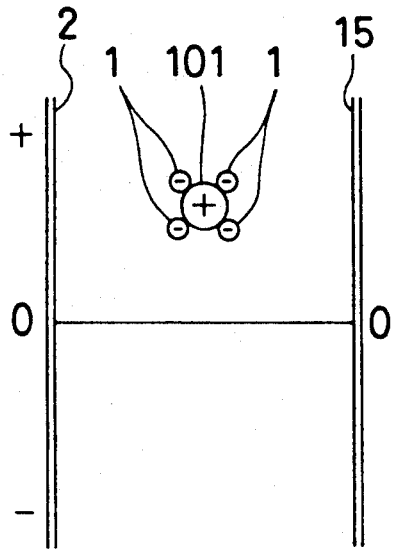
FIG. 1 is a diagram showing the state of the potential of a developer in a case where both the surface potential of an electrostatic latent image support member and the potential of a toner conveying member are zero volt in a two-components developing device.
Figure 2:
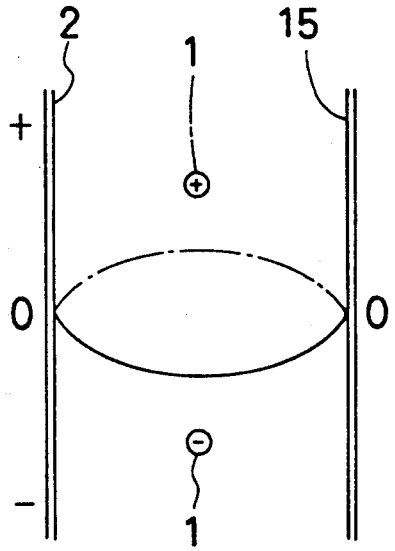
FIG. 2 is a diagram showing the state of the potential of a developer in a case where both the surface potential of an electrostatic latent image support member and the potential of a toner conveying member are zero volt in a monocomponent developing device.
Figure 3:
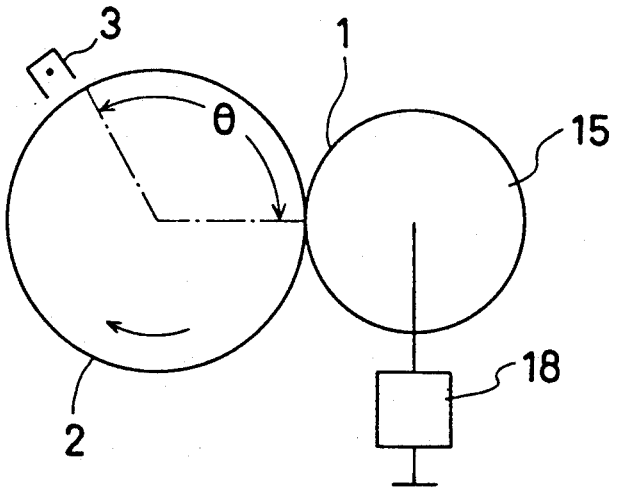
FIG. 3 is a schematic diagram showing a state where a conventional monocomponent developing device is used.
Figure 4:
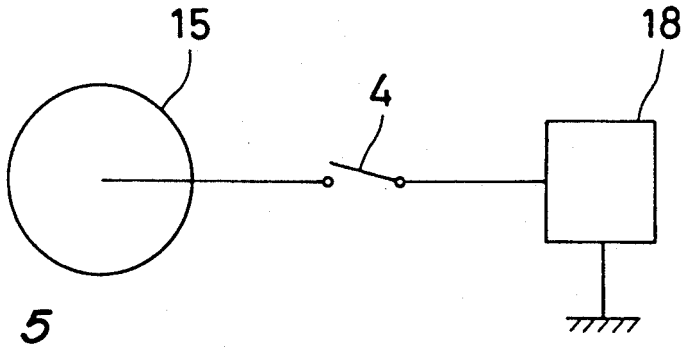
FIG. 4 is a schematic diagram showing a state where a switching device is provided between a toner conveying member and a power supply in a conventional monocomponent developing device.
Figure 5:
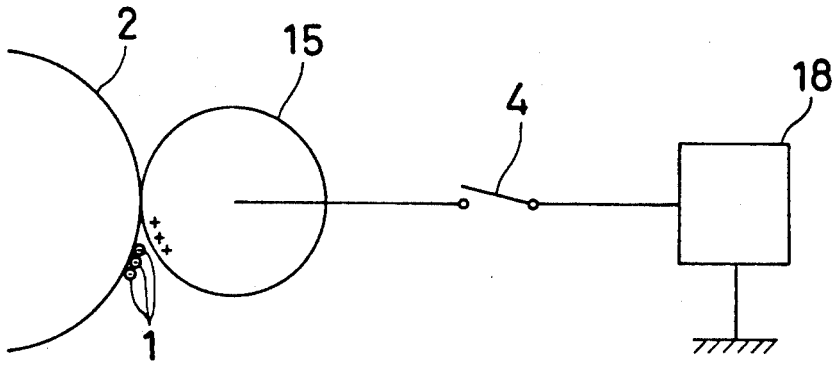
FIG. 5 is a schematic diagram showing a state where toner particles negatively charged are supplied to an electrostatic latent image support member from the toner conveying member with the switching device being turned off in the monocomponent developing device shown in FIG. 4.
Figure 6:
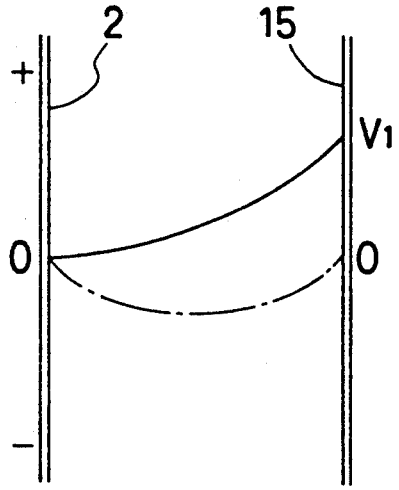
FIG. 6 is a diagram showing the state of the potential of a developer between the electrostatic latent image support member and the toner conveying member in a case where the toner particles negatively charged are supplied to the electrostatic latent image support member from the toner conveying member with the switching device being turned off as shown in FIG. 5.

In a developing device according to the present embodiment, toner particles 1 negatively charged are used as a developer.

In the developing device, the above toner particles 1 are contained in a toner containing tank 11, and an agitator 12 provided in the toner containing tank 11 is rotated to agitate the above toner particles 1 as well as to feed the toner particles 1 into a toner supplying portion 13 located on the side of a photosensitive drum (electrostatic latent image support member) 2.

The toner particles 1 thus fed into the toner supplying portion 13 are then supplied to a sleeve-shaped toner conveying member 15 provided so as to cover the outer periphery of a rotary drive roller 16, and the toner conveying member 15 is rotated as the above drive roller 16 is rotated to convey the toner particles 1 to the photosensitive drum 2.

A blade 17 is brought into contact with the surface of the toner conveying member 15 by applying pressure while the toner particles 1 are being thus conveyed toward the photosensitive drum 2 by the toner conveying member 15, to negatively charge the toner particles 1 fed into the surface of the toner conveying member 15 by triboelectric charging as well as to control the amounts of the toner particles 1 on the surface of the toner conveying member 15.

Then, the toner particles 1 thus negatively charged are introduced into a portion opposed to the photosensitive drum 2 by the toner conveying member 15 as described above, and a portion, which is projected toward the photosensitive drum 2 from the drive roller 16, of the toner conveying member 15 is brought into soft contact with the surface of the photosensitive drum 2.

The toner conveying member 15 is thus brought into soft contact with the surface of the photosensitive drum 2, and a developing bias voltage is applied to the toner conveying member 15 from a power supply 18 connected to the ground on one side through the above drive roller 16, to supply the toner particles 1 negatively charged as described above to the photosensitive drum 2 having an electrostatic latent image formed thereon from the toner conveying member 15 to develop the electrostatic latent image by reversal development.

Figure 7:
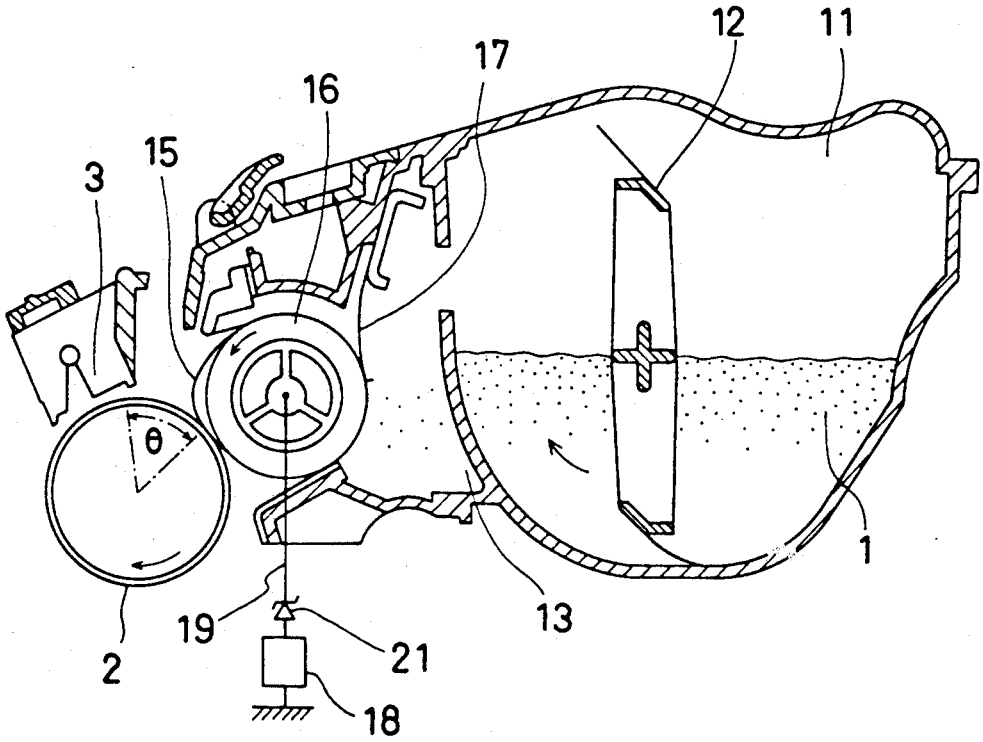
FIG. 7 is a schematic cross sectional view showing a state where a developing device according to an embodiment 1 of the present invention is used.
Figure 8:
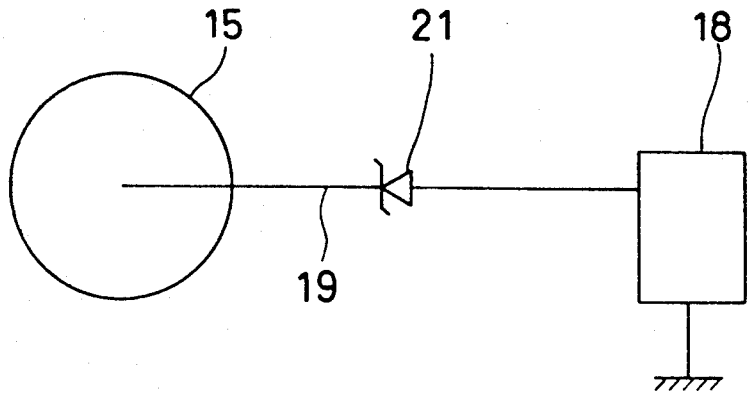
FIG. 8 is a schematic diagram showing a state where a power supply and a toner conveying member are connected in the developing device shown in FIG. 7.

In the developing device according to the present embodiment, in connecting the power supply 18 to the toner conveying member 15 through the drive roller 16 as described above, a Zener diode 21 is provided as charge movement preventing means on a lead line 19 for connecting the power supply 18 and the toner conveying member 15, as shown in FIGS. 7 and 8.

Meanwhile, when the toner particles 1 negatively charged are supplied to the photosensitive drum 2 from the toner conveying member 15, charges having positive polarity are produced in the toner conveying member 15. Accordingly, the Zener diode 21 is provided between the power supply 18 and the toner conveying member 15 in such a direction as to prevent the charges having positive polarity thus produced from flowing toward the power supply 18.

In the developing device according to the present embodiment, therefore, the above toner conveying member 15 is maintained in an electrically floating state unless the Zener diode 21 is broken down until the developing bias voltage is applied to the toner conveying member 15 from the power supply 18 as described above.

In a case where the above developing device is driven with the toner conveying member 15 being thus placed in an electrically floating state by the Zener diode 21, when a portion $\theta$, which is not charged by a charger 4, of the above photosensitive drum 2 is brought into contact with the toner conveying member 15 holding the toner particles 1 negatively charged to supply part of the toner particles 1 negatively charged to the photosensitive drum 2 from the toner conveying member 15, positive charges having opposite polarity to that of the toner particles 1 supplied are produced in the toner conveying member 15. The Zener diode 21 prevents the positive charges from flowing to the power supply 18 from the toner conveying member 15, so that the positive charges are maintained in the toner conveying member 15.

The toner particles 1 negatively charged are attracted to the toner conveying member 15 due to the positive charges thus maintained in the toner conveying member 15, not to be supplied to the photosensitive drum 2 from the toner conveying member 15, resulting in decreased wasteful consumption of the toner particles 1.

Furthermore, in applying the developing bias voltage to the toner conveying member 15 from the power supply 18 to develop the electrostatic latent image by reversal development as described above, when the toner particles 1 charged are supplied to the photosensitive drum 2 from the toner conveying member 15, positive charges having opposite polarity to that of the toner particles 1 are produced in the toner conveying member 15 in the same manner as described above. The above developing bias voltage is changed due to the positive charges. When a voltage corresponding to the positive charges produced in the toner conveying member reaches the breakdown voltage of the Zener diode 21, however, the Zener diode 21 is broken down to be rendered conductive. Accordingly, the positive charges produced in the toner conveying member 15 flow toward the power supply 18 from the toner conveying member through the Zener diode 21.

Therefore, the developing bias voltage does not vary to not less than the above breakdown voltage of the Zener diode 21, thereby to make it possible to achieve stable development to some extent.

Embodiment 2

Also in a developing device according to the present embodiment, toner particles 1 negatively charged are used as a developer, as in the developing device according to the above described embodiment 1.

Figure 9:
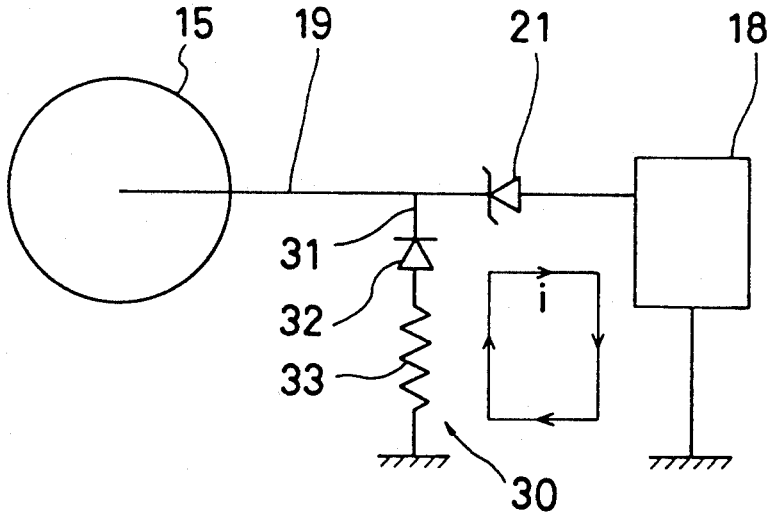
FIG. 9 is a schematic diagram showing a state where a power supply and a toner conveying member are connected in a developing device according to an embodiment 2 of the present invention.

In the developing device according to the present embodiment, in connecting a power supply 18 to a toner conveying member 15, a Zener diode 21 is provided on a lead line 19 for connecting the power supply 18 and the toner conveying member 15 in such a direction as to prevent charges having positive polarity produced in the toner conveying member 15 from flowing toward the power supply 18, as shown in FIG. 9, as in the developing device according to the above described embodiment 1.

Furthermore, in the developing device according to the present embodiment, a lead line 31 is connected between the above toner conveying member 15 and the above Zener diode 21 as conducting means 30 for breaking down the above Zener diode 21 to be rendered conductive when a developing bias voltage is applied to the toner conveying member 15 from the power supply 18. The lead line 31 is provided with a diode 32 in such a direction as to prevent charges having positive polarity produced in the toner conveying member 15 from flowing as well as a protective resistance 33 connected in series with the diode 32, and the lead line 31 is connected to the ground.

Therefore, also in the developing device according to the present embodiment, the toner conveying member 15 is maintained in an electrically floating state unless the above Zener diode 21 is broken down until the developing bias voltage is applied to the toner conveying member 15 from the power supply 18, as in the developing device according to the above described embodiment 1.

In a case where the developing device is driven with the toner conveying member 15 being thus placed in an electrically floating state, when part of the toner particles 1 negatively charged are supplied from the toner conveying member 15 to a portion $\theta$, which is not charged by a charger 4, of a photosensitive drum 2, positive charges having opposite polarity to that of the toner particles 1 supplied are produced in the toner conveying member 15, as in the developing device according to the above described embodiment 1. The positive charges are maintained in the toner conveying member 15 without flowing toward the power supply 18 from the toner conveying member 15. Accordingly, the above toner particles 1 are attracted to the toner conveying member 15 due to the positive charges, not to be supplied to the photosensitive drum 2.

On the other hand, in developing an electrostatic latent image formed on the photosensitive drum 2 by reversal development using the developing device, when the developing bias voltage is applied to the toner conveying member 15 from the above power supply 18, a current i flows to the above lead line 31 from the power supply 18 through a portion connected to the ground, as shown in FIG. 9. The current i flows into the above Zener diode 21 through the above protective resistance 33 and the above diode 32 which are provided on the lead line 31. Consequently, the Zener diode 21 is broken down to be rendered conductive. Accordingly, the positive charges produced in the toner conveying member 15 always flow toward the power supply 18 from the toner conveying member 15 through the Zener diode 21.

When the developing bias voltage is applied to the toner conveying member 15 from the power supply 18 to develop the electrostatic latent image by reversal development as described above, therefore, the developing bias voltage is kept constant, to make it possible to achieve stable reversal development.

Embodiment 3

Figure 10:
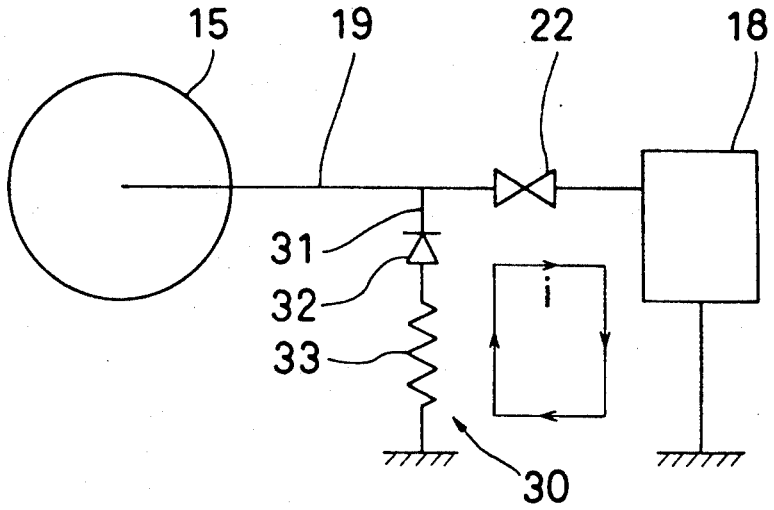
FIG. 10 is a schematic diagram showing a state where a power supply and a toner conveying member are connected in a developing device according to an embodiment 3 of the present invention.

In a developing device according to the present embodiment, a varistor 22 is used, as shown in FIG. 10, in place of the Zener diode 21 used as the charge movement preventing means in the developing devices according to the above described embodiments 1 and 2.

In the developing device according to the present embodiment, the varistor 22 is provided on a lead line 19 for connecting a power supply 18 and a toner conveying member 15, and a lead line 31 is connected between the toner conveying member 15 and the varistor 22 as in the developing device according to above described embodiment 2 as conducting means 30 for rendering the varistor 22 conductive when a developing bias voltage is applied to the toner conveying member 15 from the power supply 18, as shown in FIG. 10. The lead line 31 is provided with a diode 32 in such a direction as to prevent charges having positive polarity produced in the toner conveying member 15 from flowing as well as a protective resistance 33 connected in series with the diode 32, and the lead line 31 is connected to the ground.

As a result, when the developing device according to the present embodiment is driven, the positive charges produced in the toner conveying member 15 are maintained in the toner conveying member 15 without flowing toward the power supply 18 from the toner conveying member 15, as in the developing devices according to the above described embodiments 1 and 2. Accordingly, the above toner particles 1 are not supplied to a photosensitive drum 2 due to the positive charges.

Furthermore, in developing the electrostatic latent image by reversal development using the developing device, when the developing bias voltage is applied to the toner conveying member 15 from the above power supply 18, a current i flows to the above lead line 31 from the power supply 18 through a portion connected to the ground, as in the developing device according to the above described embodiment 2. The current i flows into the above varistor 22 through the above protective resistance 33 and the above diode 32 which are provided on the lead line 31. Consequently, the varistor 22 is rendered conductive. Accordingly, the positive charges produced in the toner conveying member 15 always flow toward the power supply 18 from the toner conveying member 15 through the varistor 22.

As a result, also in the developing device, when the developing bias voltage is applied to the toner conveying member 15 from the power supply 18 to develop the electrostatic latent image by reversal development, the developing bias voltage is kept constant, to make it possible to achieve stable reversal development, as in the developing device according to the above described embodiment 2.

Embodiment 4

In a developing device according to the present embodiment, toner particles 1 positively charged are used as a developer.

Figure 11:
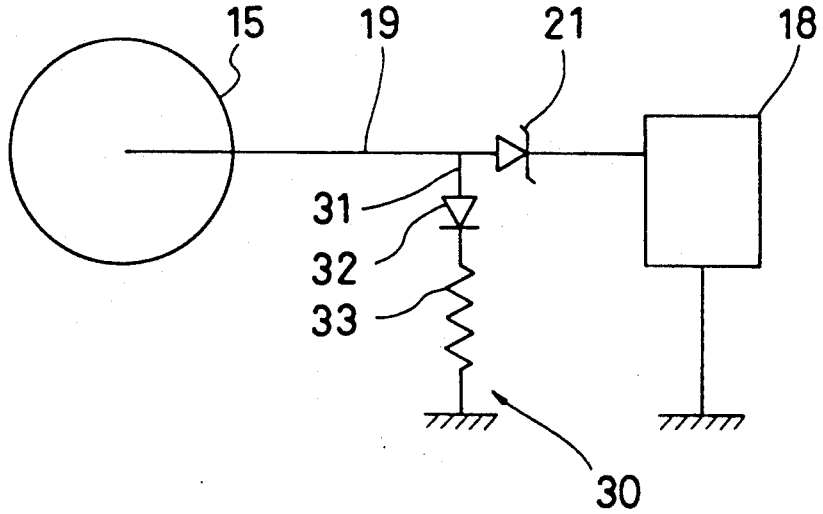
FIG. 11 is schematic diagram showing a state where a power supply and a toner conveying member are connected in a developing device according to an embodiment 4 of the present invention.

In the developing device, therefore, the direction of a Zener diode 21 is reverse to that in the developing devices according to the above described embodiments 1 and 2, as shown in FIG. 11, to prevent negative charges produced in a toner conveying member 15 from flowing toward a power supply 18 when the toner particles 1 positively charged are supplied to a photosensitive drum 2 from the toner conveying member 15.

Furthermore, in the developing device, a lead line 31 is connected between the toner conveying member 15 and the above Zener diode 21 as conducting means 30 for breaking down the Zener diode 21 to be rendered conductive when a developing bias voltage is applied to the toner conveying member 15 from the power supply 18. In connecting a diode 32 and a protective resistance 33 in series with the lead line 31 and connecting the lead line 31 to the ground, the direction of the above diode 32 is reverse to that in the developing device according to the embodiment 2, to prevent the negative charges produced in the toner conveying member 15 from flowing as described above.

In a case where the developing device according to the present embodiment is driven, when the toner particles 1 positively charged are supplied to the photosensitive drum 2 from the toner conveying member 15 so that negative charges are produced in the toner conveying member 15, the negative charges are maintained in the toner conveying member 15 without flowing to anywhere. The toner particles 1 positively charged are attracted to the toner conveying member 15 due to the negative charges, not to be supplied to the photosensitive drum 2, resulting in decreased wasteful consumption of the toner particles 1.

Furthermore, in developing an electrostatic latent image formed on the photosensitive drum 2 by reversal development using the developing device, when the developing bias voltage is applied to the toner conveying member 15 from the above power supply 18, the above Zener diode 21 is broken down to be rendered conductive. Consequently, the negative charges produced in the toner conveying member 15 flow toward the power supply 18 from the toner conveying member 15 through the Zener diode 21. Accordingly, the developing bias voltage applied to the toner conveying member 15 from the power supply 18 is kept constant, to make it possible to achieve stable reversal development.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device for supplying toner particles to an electrostatic latent image support member having an electrostatic latent image formed thereon to develop the electrostatic latent image, comprising:

a toner conveying member for conveying and supplying the toner particles to the electrostatic latent image support member having the electrostatic latent image formed thereon;

applying means for applying a predetermined developing bias voltage to said toner conveying member; and charge movement preventing means connected between said toner conveying member and said applying means for preventing charges having a polarity opposite to a polarity of the toner particles induced on the toner conveying member from flowing toward the applying means in response to charged toner particles supplied to the electrostatic latent image support member from the toner conveying member.

2. The developing device according to claim 1, wherein said charge movement preventing means prevents said charges induced in the toner conveying member from flowing toward the applying means when said applying means is not operated.

3. The developing device according to claim 2, wherein the charge movement preventing means is a Zener diode.

4. The developing device according to claim 2, wherein the charge movement preventing means is a varistor.

5. A developing device for supplying toner particles to an electrostatic latent image support member having an electrostatic latent image formed thereon to develop the electrostatic latent image, comprising:

a toner conveying member for conveying and supplying the toner particles to the electrostatic latent image support member having the electrostatic latent image formed thereon;

applying means for applying a predetermined developing bias voltage to said toner conveying member; and charge movement preventing means connected between said toner conveying member and said applying means for preventing charges having a polarity opposite to a polarity of the toner particles induced on the toner conveying member from flowing toward the applying means in response to charged toner particles supplied to the electrostatic latent image support member from the toner conveying member, said charge movement preventing means non-conductive when said applying means is inoperative and conductive when said applying means is operated.

6. The developing device according to claim 5, wherein the charge movement preventing means is a Zener diode.

7. The developing device according to claim 5, wherein the charge movement preventing means is a varistor.

8. A developing device for supplying to an electrostatic latent image support member having an electrostatic latent image formed thereon toner particles having the same polarity as that of said electrostatic latent image to develop the electrostatic latent image by reversal development, comprising:

a toner conveying member for conveying and supplying the toner particles to the electrostatic latent image support member having the electrostatic latent image formed thereon;

applying means for applying a predetermined developing bias voltage to said toner conveying member; and a voltage regulator connected between said toner conveying member and said applying means for preventing charges induced in the toner conveying member by the transition of the toner particles charged from the toner conveying member to the electrostatic latent image support member from flowing toward the applying means.

9. A developing device for supplying toner particles to an electrostatic latent image support member having an electrostatic latent image formed thereon to develop the electrostatic latent image, comprising:

a toner conveying member for conveying and supplying the toner particles to the electrostatic latent image support member having the electrostatic latent image formed thereon;

applying means for applying a predetermined developing bias voltage to said toner conveying member;

charge movement preventing means connected between said toner conveying member and said applying means for preventing charges having a polarity opposite to a polarity of the toner particles induced on the toner conveying member from flowing toward the applying means in response to charged toner particles supplied to the electrostatic latent image support member from the toner conveying member; and means connected between said toner conveying member and said charge movement preventing means for rendering said charge movement preventing means electrically conductive when said applying means is operated.

10. The developing device according to claim 9, wherein the means for rendering the charge movement preventing means electrically conductive when the applying means is operated comprises a circuit including a diode and an electrical resistance connected in series with each other and connected to the ground.

11. The developing device according to claim 9, wherein the charge movement preventing means is a varistor.

12. The developing device according to claim 9, wherein the charge movement preventing means is a Zener diode.

* * * * *